US011583465B2

(12) United States Patent
Odashima et al.

(10) Patent No.: US 11,583,465 B2
(45) Date of Patent: Feb. 21, 2023

(54) KNEE JOINT WEIGHT-BEARING APPARATUS

(71) Applicant: TOYOTA JIDOSHA KABUSHIKI KAISHA, Toyota (JP)

(72) Inventors: Tadashi Odashima, Toyota (JP); Eisuke Aoki, Toyota (JP); Tomio Ikeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 224 days.

(21) Appl. No.: 17/065,697

(22) Filed: Oct. 8, 2020

(65) Prior Publication Data

US 2021/0161749 A1 Jun. 3, 2021

(30) Foreign Application Priority Data

Nov. 28, 2019 (JP) ..... JP2019-215432

(51) Int. Cl.
*A61H 3/00* (2006.01)
*A61H 1/02* (2006.01)

(52) U.S. Cl.
CPC ..... *A61H 3/00* (2013.01); *A61H 1/0262* (2013.01); *A61H 2003/007* (2013.01); *A61H 2201/163* (2013.01); *A61H 2201/1642* (2013.01)

(58) Field of Classification Search
CPC .. A61H 3/00; A61H 1/0262; A61H 2003/007; A61H 2201/163; A61H 2201/1642
See application file for complete search history.

(56) References Cited

U.S. PATENT DOCUMENTS

| | | | | |
|---|---|---|---|---|
| 2019/0183714 | A1* | 6/2019 | Goto | A61H 1/00 |
| 2019/0282424 | A1* | 9/2019 | Lerner | A61H 1/00 |
| 2020/0069505 | A1* | 3/2020 | Fujita | A61H 1/02 |
| 2021/0007500 | A1* | 1/2021 | Vafi | A61G 5/14 |
| 2021/0330541 | A1* | 10/2021 | Katagiri | A61H 1/0237 |

FOREIGN PATENT DOCUMENTS

| | | | |
|---|---|---|---|
| JP | 2018-518318 | A | 7/2018 |
| WO | 2016210121 | A1 | 12/2016 |

* cited by examiner

*Primary Examiner* — Jerrah Edwards
*Assistant Examiner* — Aren Patel
(74) *Attorney, Agent, or Firm* — Oliff PLC

(57) ABSTRACT

The knee joint weight-bearing apparatus includes a buttock attaching part, a lower-leg attaching part, and two thigh connection units. Each thigh connection unit includes a front thigh link and a rear thigh link. The buttock attaching part, the lower-leg attaching part, the front thigh link, and the rear thigh link constitute a four-bar linkage. The buttock attaching part is configured so that when a user applies his/her weight to the buttock attaching part, a tensile force is generated in the front thigh link and a compressive force acts on the rear thigh link. The rear thigh link includes a gas spring that is configured to be stretchable in a longitudinal direction thereof and generates a resistive force against the compressive force.

7 Claims, 4 Drawing Sheets

KNEE JOINT WEIGHT-BEARING APPARATUS

CROSS REFERENCE TO RELATED APPLICATIONS

This application is based upon and claims the benefit of priority from Japanese patent application No. 2019-215432, filed on Nov. 28, 2019, the disclosure of which is incorporated herein in its entirety by reference.

BACKGROUND

The present disclosure relates to a knee joint weight-bearing apparatus.

Knee osteoarthritis in which, due to deterioration of cartilage or wear thereof in a knee joint, a pain is caused in the knee joint during walking has been know.

In the early stage of knee osteoarthritis, walking on level ground does not cause a problem, but the patient may feel a pain in his/her knee when he/she goes up and down stairs. Alternatively, the patient does not feel a pain in his/her knee during walking, but he/she cannot sit down in the Japanese "seize" style (i.e., cannot sit on his/her heels) because of a pain in his/her knee joint.

As the knee osteoarthritis progresses, both legs become O-shaped bowlegs or X-shaped bowlegs. As a result, the burden on the knee joint increases due to the wear of the cartilage and hence the knee joint becomes arthritic. Further, because of the arthritis, mere bending and stretching of the knee joint become painful. Therefore, the patient has a difficulty in not only going up and down stairs, but also walking on level ground.

Further, as the knee osteoarthritis progresses even further, the cartilage disappears (i.e., is completely worn out) and the thighbone and the shinbone directly rub against each other, thus causing a severe pain.

As a known method for surgically treating knee osteoarthritis, there is total knee replacement in which a knee joint is replaced with an artificial material made of metal or resin. As a known method for non-surgically treating knee osteoarthritis, an anti-inflammatory analgesic may be administered.

Published Japanese Translation of PCT International Publication for Patent Application, No. 2018-518318 discloses an artificial knee including a thigh link fixed to a thigh of a user, a shin link fixed to a shin thereof, and a passive compressive force generator that resists bending of the shin link with respect to the thigh link. The passive compressive force generator is, for example, an air spring or a compression coil spring.

SUMMARY

For a patient with knee osteoarthritis, the most direct cause of a pain in the knee joint is that the knee joint supports the weight of the upper body of the patient. Therefore, if a part or the whole of the load (e.g., the weight) exerted on the knee joint can be relieved, the pain in the knee joint can be alleviated.

Therefore, one of the objects of the present disclosure is to provide a knee joint weight-bearing apparatus for relieving a part or the whole of the load exerted on the knee joint.

A first exemplary aspect is a knee joint weight-bearing apparatus configured to be attached to a leg of a user and to relieve a load exerted on a knee joint of the leg, including: a buttock attaching part configured to be attached to a buttock of the user; a lower-leg attaching part configured to be attached to a lower leg of the user; and a thigh connection unit configured to connect the buttock attaching part with the lower-leg attaching part, in which the thigh connection unit includes a front thigh link configured to connect the buttock attaching part with the lower-leg attaching part, and a rear thigh link disposed rearward of the front thigh link and configured to connect the buttock attaching part with the lower-leg attaching part, the buttock attaching part, the lower-leg attaching part, the front thigh link, and the rear thigh link constitute a four-bar linkage, the buttock attaching part is configured so that when the user applies a load to the buttock attaching part, a tensile force is generated in the front thigh link and a compressive force acts on the rear thigh link, and the rear thigh link includes resistive-force generating means configured to be able to expand and contract in a longitudinal direction thereof, and to generate a resistive force against the compressive force. According to the above-described configuration, since the buttock attaching part is connected with the lower-leg attaching part by the thigh connection unit, a part or the whole of the load (e.g., the weight) exerted on the knee joint of the user can be relieved. Further, when the user bends his/her knee joint, the rear thigh link becomes shorter, so that the posture of the buttock attaching part does not change easily and hence the user can easily continue applying the load to the buttock attaching part.

The front thigh link may be lighter than the rear thigh link. That is, since only the tensile force acts on the front thigh link, the front thigh link can be made less rigid than the rear thigh link is. Therefore, the above-described configuration contributes to reducing the weight of the knee joint weight-bearing apparatus.

The front thigh link may include a front thigh link upper part connected to the buttock attaching part, a front thigh link lower part connected to the lower-leg attaching part, and a front upper/lower connection part configured to detachably connect the front thigh link upper part with the front thigh link lower part. According to the above-described configuration, it is possible to detach the front thigh link upper part from the front thigh link lower part, and thereby to fold the knee joint weight-bearing apparatus and made it compact in size.

The rear thigh link and the lower-leg attaching part may be connected to each other below the knee joint. According to the above-described configuration, since the inclination of the rear thigh link when the knee joint is bent is reduced, the user can easily apply the load to the buttock attaching part along the longitudinal direction of the rear thigh link.

The rear thigh link may include a rear thigh link upper part connected to the buttock attaching part, a rear thigh link lower part connected to the lower-leg attaching part, and a rear upper/lower connection part configured to connect the rear thigh link upper part with the rear thigh link lower part in such a manner that they can be switched between a relatively rotatable state and a relatively non-rotatable state. Further, the rear upper/lower connection part is disposed near the knee joint. According to the above-described configuration, by making the rear thigh link upper part and the rear thigh link lower part rotatable relative to each other, the rear thigh link can be bent near the knee joint, so that the rear thigh link does not stand in the way when the user sits on a chair or the like.

The knee joint weight-bearing apparatus may include a pair of thigh connection units disposed on both sides of the leg.

A front thigh link of at least one of the pair of thigh connection units may be made of a flexible material, and a link length of the front thigh link may be adjustable. According to the above-described configuration, by making the link lengths of the front thigh links of the pair of thigh connection units different from each other, the rear thigh link corresponding to the shorter front thigh link becomes shorter before the other rear thigh link does when the user applies the load to the buttock attaching part. Consequently, it is possible to guide the center of gravity of the user to the rear thigh link side. Therefore, for example, it is possible to alleviate the pain in the knee joint of the user by guiding the center of gravity of the user according to whether the user's legs are O-shaped bowlegs or X-shaped bowlegs.

According to the present disclosure, it is possible to relieve a part or the whole of the load (e.g., the weight) exerted on the knee joint of the user.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Embodiments according to the present disclosure will be described hereinafter with reference to FIGS. 1 to 4.

Figure 1:
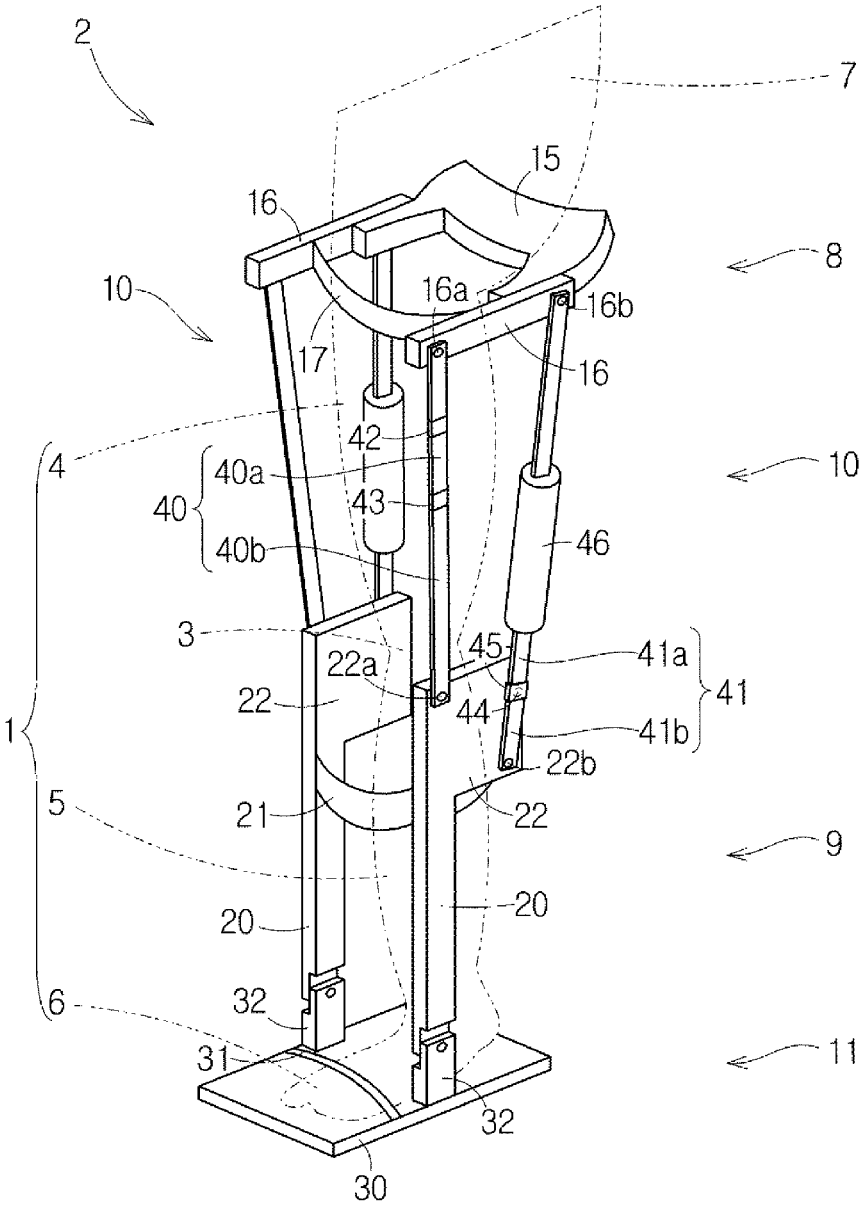
FIG. 1 is a perspective view of a knee joint weight-bearing apparatus.

FIG. 1 shows a knee joint weight-bearing apparatus 2 which is attached to a leg 1 of a user when it is used. The knee joint weight-bearing apparatus 2 is typically used while being attached to one of the two legs 1 of the user in which the user suffers from knee osteoarthritis. However, one knee joint weight-bearing apparatus 2 may be attached to each of both of the legs 1.

The knee joint weight-bearing apparatus 2 is an apparatus that, by being attached to the leg 1 of the user, relieves a part or the whole of the load (e.g., the weight) exerted on the knee joint 3 of the leg 1. In this embodiment, by being attached to the leg 1 of the user, the knee joint weight-bearing apparatus 2 relieves a part of the load exerted on the knee joint 3 of the leg 1.

As known, the leg 1 includes a thigh 4, a lower leg 5, and a foot 6. A buttock 7 is positioned above the leg 1. The knee joint 3 is a joint that connects the thigh 4 with the lower leg 5.

The knee joint weight-bearing apparatus 2 includes a buttock attaching part 8, a lower-leg attaching part 9, and two thigh connection units 10. The knee joint weight-bearing apparatus 2 further includes a foot attaching part 11.

In the following description, a front/rear direction and a left/right direction are defined based on the orientation of the body of the user. A forward direction may be defined as the normal walking direction of the user. The left/right direction may be defined as the longitudinal direction of a line segment that horizontally connects the right and the left arms.

(Buttock Attaching Part 8)

The buttock attaching part 8 is a part that is attached to the buttock 7 of the user and supports the buttock 7 of the user. The buttock attaching part 8 includes a buttock facing part 15, two buttock frames 16, and a buttock fixing band 17.

The buttock facing part 15 is a part that is substantially opposed to (i.e., faces) the hipbone of the buttock 7 of the user when the user is in a standing position or a sitting position. In this embodiment, the buttock facing part 15 is positioned rearward of and below the hipbone of the user's buttock 7. The buttock facing part 15 may has an open-cell structure such as urethane foam, or a closed-cell structure such as polyethylene foam for the purpose of dispersing a contact pressure exerted to the user.

The two buttock frames 16 are arranged so as to sandwich the user's thigh 4 in the left/right direction of the user. Each of the buttock frames 16 is fixed to the buttock facing part 15 by, for example, a screw and extends forward from the buttock facing part 15. Each of the buttock frames 16 horizontally extends substantially in a straight line along the front/rear direction of the user when the user is in the standing position. It can be expressed that the two buttock frames 16 are connected to each other by the buttock facing part 15. Each of the buttock frames 16 includes a front thigh link upper end connection part 16*a* and a rear thigh link upper end connection part 16*b*. The front thigh link upper end connection part 16*a* is positioned forward of the rear thigh link upper end connection part 16*b*.

The buttock fixing band 17 is a band for fixing the buttock attaching part 8 to the base of the user's thigh 4, and is disposed between the two buttock frames 16. The buttocks fixing band 17 is disposed so as to connect two buttocks frames 16 with each other. The buttock fixing band 17 is disposed on the opposite side to the buttock facing part 15 across the user's thigh 4. By the above-described configuration, the user can appropriately attach the buttock attaching part 8 to his/her buttock 7 by adjusting the band length of the buttock fixing band 17 according to the thickness of the base of the user's thigh 4.

(Lower-Leg Attaching Part 9)

The lower-leg attaching part 9 is a part that is attached to the lower leg 5 of the user. The lower-leg attaching part 9 includes two lower-leg facing parts 20 and a lower leg fixing band 21.

The two lower-leg facing parts 20 are arranged so as to sandwich the user's lower leg 5 in the left/right direction. Each of the lower-leg facing parts 20 vertically extends along the lower leg 5. A thigh link connection part 22, to which a respective one of the thigh connection units 10 is connected, is formed at the upper end of each of the lower-leg facing parts 20.

The thigh link connection part 22 includes a front thigh link lower end connection part 22*a* and a rear thigh link lower end connection part 22*b*. The front thigh link lower end connection part 22*a* is positioned forward of and above the rear thigh link lower end connection part 22*b*. The front thigh link lower end connection part 22*a* is positioned at roughly the same height as the user's knee joint 3 when the user is in the standing state. The rear thigh link lower end connection part 22*b* is positioned below the user's knee joint 3 when the user is in the standing state. Specifically, when the height of the user is represented by HT, the rear thigh link lower end connection part 22*b* is disposed at a position that is lower than the user's knee joint 3 by a length HT*0.1 to HT*0.15 when the user is in the standing state.

The lower end of each of the lower-leg facing parts 20 is rotatably connected to the foot attaching part 11.

(Foot Attaching Part 11)

The foot attaching part 11 is a part that is fixed to the foot 6 of the user. As shown in FIG. 1, like a sandal, the foot attaching part 11 may include a sole part 30 that is opposed to (i.e., faces) the sole of the foot 6, a foot fixing band 31 that is opposed to (i.e., faces) the instep of the foot 6, and two foot projecting parts 32. The user can appropriately attach the foot attaching part 11 to his/her foot 6 by putting the foot 6 between the sole part 30 and the foot fixing band 31 and adjusting the band length of the foot fixing band 31. The two foot projecting parts 32 project upward from the sole part 30 so as to sandwich the foot 6 in the left/right direction. The lower end of each of the lower-leg facing parts 20 of the lower-leg attaching part 9 is rotatably connected to the upper end of a respective one of the leg projecting parts 32 of the leg attaching part 11. Note that the foot attaching part 11 may be formed like a boot, a sneaker, a leather shoe, or a slip-on, instead of being formed like a sandal. For example, when the foot attaching part 11 is formed like a boot, the lower end of each of the lower-leg facing parts 20 of the lower-leg attaching part 9 is rotatably connected to one (or some) of the components constituting the boot.

(Thigh Connecting Unit 10)

The two thigh connection units 10 are arranged so as to sandwich the user's thigh 4 in the left/right direction. Each of the thigh connection units 10 extends in the vertical direction when the user is in the standing state. Each of the thigh connection units 10 connects the buttock attaching part 8 with the lower-leg attaching part 9. Details of the thigh connection units 10 are described hereinafter.

Each of the thigh connection units 10 includes a front thigh link 40 and a rear thigh link 41. The front thigh link 40 connects the buttock attaching part 8 with the lower-leg attaching part 9. The rear thigh link 41 also connects the buttock attaching part 8 with the lower-leg attaching part 9. The rear thigh link 41 is disposed rearward of the front thigh link 40. The longitudinal directions of the front and rear thigh links 40 and 41 are roughly parallel to each other. The front and rear thigh links 40 and 41 extend roughly vertically when the user is in the standing state.

The upper end of the front thigh link 40 of each of the thigh connection units 10 is rotatably connected to the front thigh link upper end connection part 16*a* of a respective one of the buttock frames 16 of the buttock attaching part 8. The lower end of the front thigh link 40 of each of the thigh connection units 10 is rotatably connected to the front thigh link lower end connection part 22*a* of the thigh link connection part 22 of a respective one of the lower leg facing parts 20 of the lower-leg attaching part 9.

The upper end of the rear thigh link 41 of each of the thigh connection units 10 is rotatably connected to the rear thigh link upper end connection part 16*b* of a respective one of the buttock frames 16 of the buttock attaching part 8. The lower end of the rear thigh link 41 of each of the thigh connection units 10 is rotatably connected to the rear thigh link lower end connection part 22*b* of the thigh link connection part 22 of a respective one of the lower leg facing parts 20 of the lower-leg attaching part 9.

Therefore, each of the buttock frames 16 of the buttock attaching part 8, the front and rear thigh links 40 and 41 of a respective one of the thigh connection units 10, and the thigh link connection part 22 constitute the so-called four-bar linkage.

In this embodiment, the front thigh link 40 is a string made of a flexible material, typically made of a polyamide synthetic resin such as nylon. The front thigh link 40 is formed by connecting the front thigh link upper part 40*a* with the front thigh link lower part 40*b*. Further, the front thigh link 40 includes a length adjusting mechanism 42 and a detaching mechanism 43 (a front upper/lower connection part). The length adjusting mechanism 42 is a mechanism for adjusting the link length of the front thigh link 40, i.e., the distance between the front thigh link upper end connection part 16*a* and the front thigh link lower end connection part 22*a*, and is typically formed by a belt feed. In this embodiment, the length adjusting mechanism 42 adjusts the link length of the front thigh link upper part 40*a*. However, instead of adjusting the link length of the front thigh link upper part 40*a*, the link length of the front thigh link lower part 40*b* may be adjusted. The detaching mechanism 43 is a mechanism for temporarily detaching the front thigh link 40, and is typically a buckle. The detaching mechanism 43 detachably connects the front thigh link upper part 40*a* with the front thigh link lower part 40*b*.

In this embodiment, the front thigh link 40 is made of a flexible material. However, the front thigh link 40 may be made of a non-flexible material. For example, the front thigh link 40 is formed of a beam made of metal or wood. Further, specific examples of the flexible material are not limited to the above-shown synthetic resins and may include metals. In such cases, the front thigh link 40 may be a metal wire.

The rear thigh link 41 is composed of a rear thigh link upper part 41*a* and a rear thigh link lower part 41*b*. The rear thigh link upper part 41*a* and the rear thigh link lower part 41*b* are rotatably connected to each other at a rear thigh connection part 44. The rear thigh connection part 44 is provided with a switching snap 45 (a rear upper/lower connection part) for switching between a state in which the rear thigh link upper part 41*a* is relatively rotatable with respect to the rear thigh link lower part 41*b* and a state in which the rear thigh link upper part 41*a* is not rotatable with respect to the rear thigh link lower part 41*b*. The switching snap 45 is typically a tubular member provided in the rear thigh link lower part 41*b* in such a manner that the tubular member is slidable along the rear thigh link lower part 41*b* in its longitudinal direction. In this case, when the switching snap 45 is slid upward and thereby covers both the rear thigh link upper part 41*a* and the rear thigh link lower part 41*b* at the same time, the rear thigh link upper part 41*a* becomes the aforementioned non-rotatable state. Further, when the switching snap 45 is slid downward and hence does not cover the rear thigh link upper part 41*a*, the rear thigh link upper part 41*a* becomes the aforementioned rotatable state. The configuration of the switching snap 45 is not limited to the above-described configuration. That is, other known configurations may be adopted for the switching snap 45. The rear thigh connection part 44 and the switching snap 45 are disposed near the knee joint 3.

A gas spring 46 (resistive-force generating means) is provided in the rear thigh link upper part 41*a*. The gas spring 46 is a spring using a reaction force of a compressed gas, and obtains the reaction force by filling a sealed cylinder with a nitrogen gas, which is used as the compressed gas, and compressing the gas by a piston. The gas spring 46 is configured so that the rear thigh link upper part 41*a* can extend and contract in the longitudinal direction thereof. The gas spring 46 generates a roughly constant repulsive force irrespective of the link length of the rear thigh link upper part 41*a* in the direction in which the link length of the rear thigh link upper part 41*a* increases.

Regarding the buttock attaching part 8, the buttock attaching part 8 is considered to be a problem of a beam in which the buttock attaching part 8 is simply supported by the front and rear thigh link upper end connection parts 16*a* and 16*b*, and distributed loads (e.g., distributed weights) are exerted downward on the buttock facing part 15. In this case, the buttock facing part 15 is configured so that a concentrated load equivalent to downward distributed loads exerted on the buttock facing part 15 is exerted on a part of the buttock facing part 15 located rearward of the rear thigh link upper end connection part 16*b*. Therefore, when the user applies a load (e.g., his/her weight) to the buttock facing part 15, a tensile force is generated in the front thigh link 40 and a compressive force acts on the rear thigh link 41.

Further, the repulsive force generated by the gas spring 46 is the resistive force itself against the above-described compressive force.

The above-described knee joint weight-bearing apparatus 2 is particularly suitable for knee osteoarthritis.

The knee osteoarthritis causes a symptom in which cartilage in a knee joint deteriorates or is worn away, causing a pain in the knee joint during walking.

In the early stage of knee osteoarthritis, walking on level ground does not cause a problem, but the patient may feel a pain in his/her knee when he/she goes up and down stairs. Alternatively, the patient does not feel a pain in his/her knee during walking, but he/she cannot sit down in the Japanese "seiza" style (i.e., cannot sit on his/her heels) because of a pain in his/her knee joint.

As the knee osteoarthritis progresses, both legs become O-shaped bowlegs or X-shaped bowlegs. As a result, the burden on the knee joint increases due to the wear of the cartilage and hence the knee joint becomes arthritic. Further, because of the arthritis, mere bending and stretching of the knee joint become painful. Therefore, the patient has a difficulty in not only going up and down stairs, but also walking on level ground.

Further, as the knee osteoarthritis progresses even further, the cartilage disappears (i.e., is completely worn out) and the thighbone and the shinbone directly rub against each other, thus causing a severe pain.

For a patient with knee osteoarthritis, the most direct cause of a pain in the knee joint is that the knee joint supports the weight of the upper body of the patient. Therefore, if a part or the whole of the load (e.g., the weight) exerted on the knee joint can be relieved, the pain in the knee joint can be alleviated.

Therefore, the knee joint weight-bearing apparatus 2 functions as an apparatus for relieving a part or the whole of the load exerted on the knee joint 3. In this embodiment, the knee joint weight-bearing apparatus 2 functions as an apparatus for relieving a part of the load exerted on the knee joint 3.

Specifically, once the knee joint weight-bearing apparatus 2 is attached to the leg 1, the user feels, when he/she walks, as if he/she is walking while sitting on a chair at all times. Note that the buttock attaching part 8 of the knee joint weight-bearing apparatus 2 functions as a sitting surface of the chair, and both of the thigh connection units 10 and the lower-leg attaching part 9 function as legs of the chair.

Specific operations of the knee joint weight-bearing apparatus 2 are described hereinafter.

Figure 2:
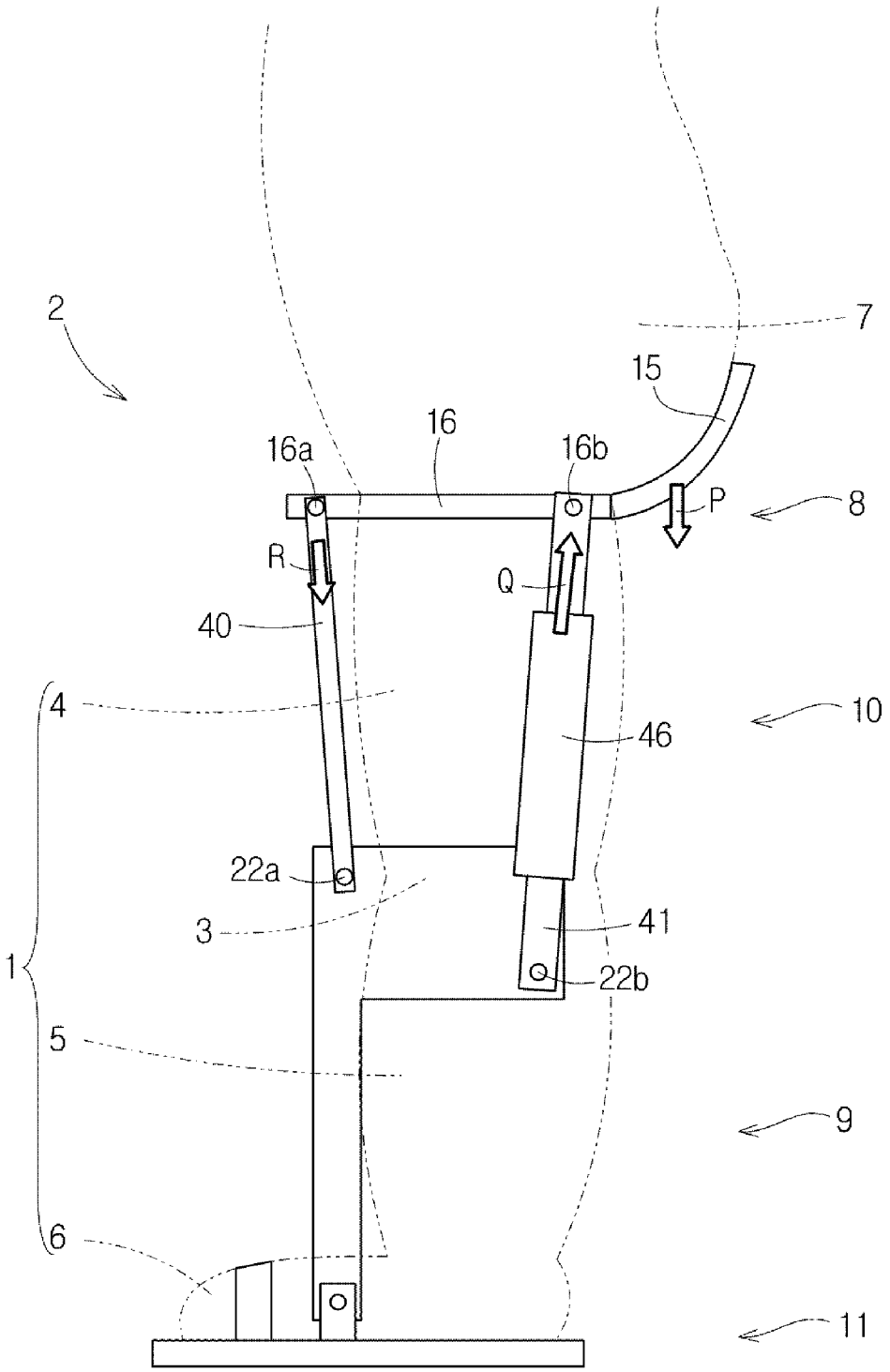
FIG. 2 is a schematic side view of the knee joint weight-bearing apparatus when the knee joint is stretched.

That is, as shown in FIG. 2, when a user applies a load P (e.g., his/her weight) to the buttock facing part 15, this load is received by the two thigh connection units 10 and the lower-leg attaching part 9. In this state, a compressive force acts on the rear thigh link 41 of each of the thigh connection units 10. Meanwhile, a tensile force R acts on the front thigh link 40 of each of the thigh connection units 10. The following relation holds: the front thigh link upper end connection part 16*a* acts as a fulcrum; the buttock facing part 15 becomes a point of force; and the rear thigh link upper end connection part 16*b* becomes a point of action. In this state, the gas spring 46 generates a resistive force Q against the compressive force acting on the rear thigh link 41. A part of the load exerted on the user's knee joint 3 is relieved by this resistive force Q.

Figure 3:
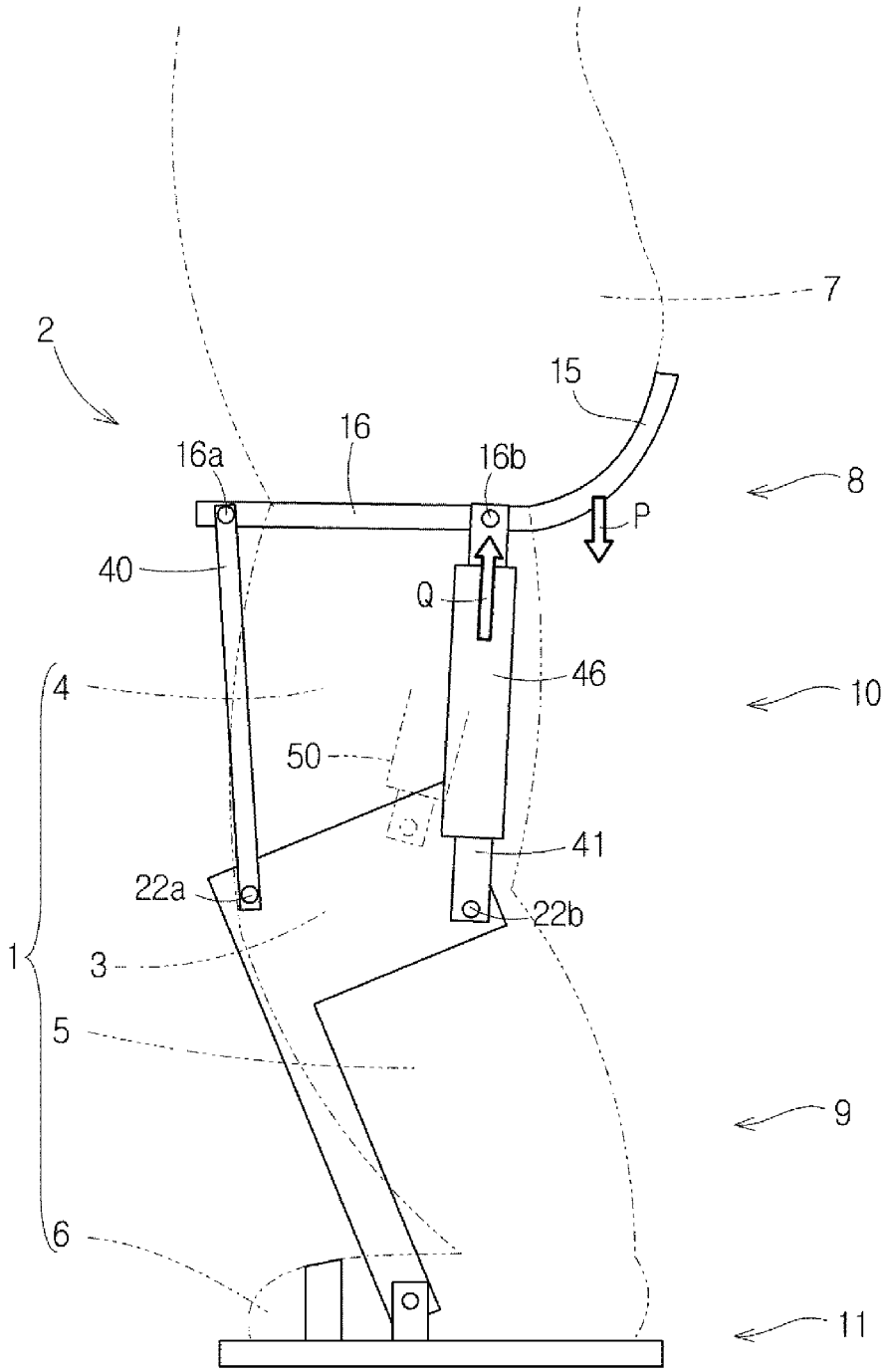
FIG. 3 is a schematic side view of the knee joint weight-bearing apparatus when the knee joint is bent.

Next, as shown in FIG. 3, when the knee joint 3 of the leg 1 is bent, the lower leg 5 is inclined forward. Therefore, the lower-leg attaching part 9 is also inclined forward in a similar manner. In this state, since the gas spring 46 becomes moderately short, the posture of the buttock facing part 15 does not lean forward. Therefore, the user can easily continue applying the load to the buttock attaching part 8 without feeling that anything is wrong. That is, the function of the knee joint weight-bearing apparatus 2 for relieving a part of the load exerted on the user's knee joint 3 is continuously performed without causing any problem.

Note that as shown in FIG. 2, the rear thigh link lower end connection part 22*b* is disposed below the knee joint 3 and away from the knee joint 3 when the user is in the standing position. Therefore, as compared to the case where the rear thigh link lower end connection part 22*b* is disposed at the same height as the knee joint 3 when the user is in the standing position as shown by phantom lines 50 in FIG. 3, the inclination of the rear thigh link 41 that is caused when the knee joint 3 is bent is reduced. Therefore, the longitudinal direction of the rear thigh link 41 roughly coincides with the direction in which the user applies the load to the buttock attaching part 8, thus providing an advantage that the user can easily apply the load to the buttock attaching part 8 along the longitudinal direction of the rear thigh link 41. In other words, as compared to the case where the rear thigh link lower end connection part 22*b* is disposed at the same height as the knee joint 3 when the user is in the standing position as shown by the phantom lines 50 in FIG. 3, when the knee joint 3 is bent, the user can easily compress the gas spring 46 and hence can stabilize the posture of the buttock attaching part 8 without inclining it forward.

Figure 4:
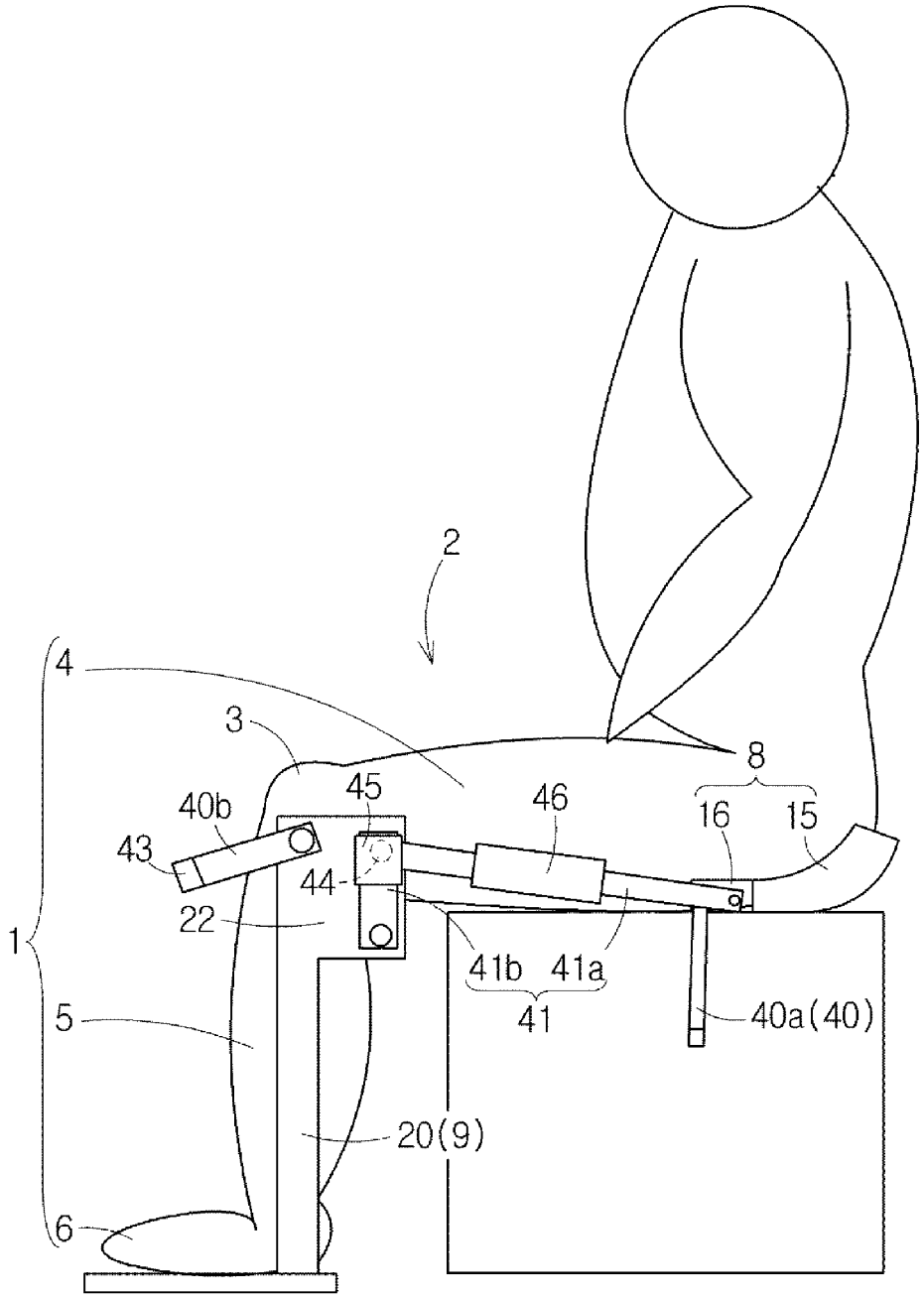
FIG. 4 shows a state in which a user sits on a chair while wearing the knee joint weight-bearing apparatus.

FIG. 4 shows a sitting position of a user. The sitting position means a position (i.e., a posture) in which the user sits on a chair or the like. As shown in FIG. 4, when a user with the knee joint weight-bearing apparatus 2 attached to his/her leg change his/her position from the standing position to the sitting position, he/she brings the rear thigh link upper part 41*a* and the rear thigh link lower part 41*b* of each of the thigh connection units 10 into a relatively rotatable state by using the switching snap 45. In addition, he/she may detach the front thigh link upper part 40*a* from the front thigh link lower part 40*b* by using the detaching mechanism 43. In this way, the front thigh link 40 can be bent at the rear thigh connection part 44. To begin with, the rear thigh connection part 44 is disposed near the knee joint 3, so that the knee joint weight-bearing apparatus 2 does not hamper the bending motion of the knee joint 3 by the user.

Preferred embodiments according to the present disclosure have been described above, and the above-described embodiments include the below-described features.

The knee joint weight-bearing apparatus 2 is an apparatus that is attached to a leg 1 of a user and relieves a load exerted on a knee joint 3 of the leg 1. The knee joint weight-bearing apparatus 2 includes a buttock attaching part 8 attached to a buttock 7 of the user, a lower-leg attaching part 9 attached to the lower leg 5 of the user, and two thigh connection units 10 that connects the buttock attaching part 8 with the lower-leg attaching part 9. Each of the thigh connection units 10 includes a front thigh link 40 that connects the buttock attaching part 8 with the lower-leg attaching part 9, and a rear thigh link 41 that is disposed rearward of the front thigh link 40 and connects the buttock attaching part 8 with the lower-leg attaching part 9. The buttock attaching part 8, the lower-leg attaching part 9, and the front and rear thigh links 40 and 41 constitute a four-bar linkage. The buttock attaching part 8 is configured so that when the user applies a load (e.g., his/her weight) to the buttock attaching part 8, a tensile force is generated in the front thigh link 40 and a compressive force acts on the rear thigh link 41. The rear thigh link 41 includes a gas spring 46 (resistive-force generating means) that is configured to be able to expand and contract in a longitudinal direction thereof, and to generate a resistive force Q against the compressive force. According to the above-described configuration, since the buttock attaching part 8 is connected with the lower-leg attaching part 9 by the thigh connection units 10, a part of the load exerted on the user's knee joint 3 can be relieved. Further, when the user bends his/her knee joint 3, the rear thigh link 41 becomes shorter, so that the posture of the buttock attaching part 8 does not change easily and hence the user can easily continue applying the load to the buttock attaching part 8.

Note that in this embodiment, the knee joint weight-bearing apparatus 2 includes two thigh connection units 10. However, the knee joint weight-bearing apparatus 2 may include only one thigh connection unit 10.

Further, as the means for generating the resistive force Q against the compressive force acting on the rear thigh link 41, a structure having a damper characteristic different from that of the gas spring 46 may be adopted in place of the gas spring 46. Examples of the structure having other types of damper characteristics include a coil spring, a gas damper, an oil damper, and an oilless gas spring. The coil spring has some degree of a damper characteristic.

Further, the front thigh link 40 is lighter than the rear thigh link 41. That is, since only the tensile force acts on the front thigh link 40, the front thigh link 40 can be made less rigid than the rear thigh link 41 is. Therefore, the above-described configuration contributes to reducing the weight of the knee joint weight-bearing apparatus 2.

Further, the front thigh link 40 also includes a front thigh link upper part 40*a* connected to the buttock attaching part 8, a front thigh link lower part 40*b* connected to the lower-leg attaching part 9, and a detaching mechanism 43 (a front upper/lower connection part) that detachably connects the front thigh link upper part 40*a* with the front thigh link lower part 40*b*. According to the above-described configuration, it is possible to detach the front thigh link upper part 40*a* from the front thigh link lower part 40*b*, and thereby to fold the knee joint weight-bearing apparatus 2 and made it compact in size.

Further, the rear thigh link 41 and the lower-leg attaching part 9 are connected to each other below the knee joint 3. According to the above-described configuration, as shown in FIG. 3, since the inclination of the rear thigh link 41 when the knee joint 3 is bent is reduced, the user can easily apply the load to the buttock attaching part 8 along the longitudinal direction of the rear thigh link 41.

Further, the rear thigh link 41 also includes a rear thigh link upper part 41*a* connected to the buttock attaching part 8, a rear thigh link lower part 41*b* connected to the lower-leg attaching part 9, and a switching snap 45 (a rear upper/lower connection part) that connects the rear thigh link upper part 41*a* with the rear thigh link lower part 41*b* in such a manner that they can be switched between a relatively rotatable state and a relatively non-rotatable state. The switching snap 45 is disposed near the knee joint 3. According to the above-described configuration, by making the rear thigh link upper part 41*a* and the rear thigh link lower part 41*b* rotatable to each other, the rear thigh link 41 can be bent near the knee joint 3, so that the rear thigh link 41 does not stand in the way when the user sits on a chair or the like.

Further, the knee joint weight-bearing apparatus 2 includes a pair of thigh connection units 10 on both sides of the leg 1.

Further, the front thigh link 40 of at least one of the pair of thigh connection units 10 is made of a flexible material, and the link length of the front thigh link 40 is adjustable. By the above-described configuration, one of the front thigh links 40 is intentionally loosened in the standing position shown in FIG. 1. As a result, when the user applies a load (e.g., his/her weight) to the buttock attaching part 8, the rear thigh link 41 corresponding to the other front thigh link 40 becomes shorter before the rear thigh link 41 corresponding to the one front thigh link 40 does. This is because a compressive force cannot be applied to the rear thigh link 40 while the front thigh link 41 is loosened, and hence the rear thigh link 41 does not become shorter. Then, the center of gravity of the user is guided to the one of the two rear thigh links 41 that becomes shorter before the other rear thigh link 41 does. By shifting the timings at which the two rear thigh links 41 become shorter from each other as described above, the center of gravity of the user can be guided to either the left side or the right side.

For example, in the case where the user's legs are O-shaped bowlegs, the patient feels a pain particularly in the inner side of the knee joint 3 because the inner-side cartilage is particularly damaged in the knee joint 3. Therefore, by guiding the center of gravity of the user to the outer side, the load exerted on the knee joint 3 can be guided to the outer side, so that the pain that the patient feels on the inner side of the knee joint 3 can be alleviated.

The above-described first embodiment can be modified as described below.

That is, in the rear thigh link lower end connection part 22*b*, which connects the rear thigh link 41 and the lower leg facing part 20, a bending/stretching assisting motor that controls the angle between the rear thigh link 41 and the lower leg facing part 20 is provided, so that the bending/stretching motion of the knee joint may be assisted.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A knee joint weight-bearing apparatus configured to be attached to a leg of a user and to relieve a load exerted on a knee joint of the leg, comprising:

a buttock attaching part configured to be attached to a buttock of the user, the buttock attaching part comprising a buttock facing part positioned rearward of and below a hipbone of the buttock of the user to face the hipbone, and a buttock frame fixed to the buttock facing part and extending forward from the buttock facing part;

a lower-leg attaching part configured to be attached to a lower leg of the user; and a thigh connection unit configured to connect the buttock attaching part with the lower-leg attaching part, wherein the buttock frame includes a front thigh link upper end connection part and a rear thigh link upper end connection part, the front thigh link upper end connection part being positioned forward of the rear thigh link upper end connection part, the lower-leg attaching part includes a thigh link connection part, the thigh link connection part including a front thigh link lower end connection part and a rear thigh link lower end connection part, the front thigh link lower end connection part being positioned forward of and above the rear thigh link lower end connection part, the thigh connection unit comprises a front thigh link configured to connect the buttock attaching part with the lower-leg attaching part, and a rear thigh link disposed rearward of the front thigh link and configured to connect the buttock attaching part with the lower-leg attaching part, the front thigh link has an upper end rotatably connected to the front thigh link upper end connection part and a lower end rotatably connected to the front thigh link lower end connection part, the rear thigh link has an upper end rotatably connected to the rear thigh link upper end connection part and a lower end rotatably connected to the rear thigh link lower end connection part, the buttock attaching part, the lower-leg attaching part, the front thigh link, and the rear thigh link constitute a four-bar linkage, the buttock attaching part is configured so that when the user applies a load to the buttock attaching part, a tensile force is generated in the front thigh link and a compressive force acts on the rear thigh link, the rear thigh link comprises a gas spring configured to expand and contract in a longitudinal direction to generate a resistive force against the compressive force, and to generate a roughly constant repulsive force irrespective of a link length of the rear thigh link in a direction in which the link length of the rear thigh link increases, and the front thigh link is a string made of a flexible material.

2. The knee joint weight-bearing apparatus according to claim 1, wherein the front thigh link is lighter than the rear thigh link.

3. The knee joint weight-bearing apparatus according to claim 1, wherein the front thigh link comprises a front thigh link upper part connected to the buttock attaching part, a front thigh link lower part connected to the lower-leg attaching part, and a front upper upper/lower connection part configured to detachably connect the front thigh link upper part with the front thigh link lower part.

4. The knee joint weight-bearing apparatus according to claim 1, wherein the rear thigh link and the lower-leg attaching part are connected to each other below the knee joint.

5. The knee joint weight-bearing apparatus according to claim 4, wherein the rear thigh link comprises a rear thigh link upper part connected to the buttock attaching part, a rear thigh link lower part connected to the lower-leg attaching part, and a rear upper/lower connection part configured to connect the rear thigh link upper part with the rear thigh link lower part in such a manner that they can be switched between a relatively rotatable state and a relatively non-rotatable state, and the rear upper/lower connection part is disposed near the knee joint.

6. The knee joint weight-bearing apparatus according to claim 1, further comprising a pair of thigh connection units disposed on both sides of the leg.

7. The knee joint weight-bearing apparatus according to claim 6, wherein a link length of a front thigh link of at least one of the pair of thigh connection units is adjustable.

* * * * *